US005337773A

United States Patent [19]

Michael

[11] Patent Number: 5,337,773

[45] Date of Patent: Aug. 16, 1994

[54] VACUUM-OPERATED DRAINING SYSTEMS

[76] Inventor: Harald Michael, Gosslers Park 9, 2000 Hamburg 55, Fed. Rep. of Germany

[21] Appl. No.: 62,559

[22] Filed: May 18, 1993

[30] Foreign Application Priority Data

May 20, 1992 [DE] Fed. Rep. of Germany ..... 4216628

[51] Int. Cl.[5] ..... F16K 11/20; E03B 7/02

[52] U.S. Cl. ..... 137/1; 137/236.1; 137/606

[58] Field of Search ..... 137/236.1, 606, 1

[56] References Cited

U.S. PATENT DOCUMENTS

| | | | |
|---|---|---|---|
| 4,171,853 | 10/1979 | Cleaver et al. | 251/61.5 X |
| 4,179,371 | 12/1979 | Foreman et al. . | |
| 4,333,487 | 6/1982 | Micheal | 137/236.1 X |
| 4,373,838 | 2/1983 | Foreman et al. | 137/236.1 X |
| 4,691,731 | 9/1987 | Grooms et al. | 137/236.1 X |
| 5,064,314 | 11/1991 | Grooms et al. . | |
| 5,074,718 | 12/1991 | Ushitora et al. | 137/236.1 X |
| 5,083,885 | 1/1992 | Ushitora et al. . | |

FOREIGN PATENT DOCUMENTS

| | | |
|---|---|---|
| 0216101 | 8/1986 | European Pat. Off. . |
| 0341595 | 11/1989 | European Pat. Off. . |
| 2637962 | 10/1979 | Fed. Rep. of Germany . |
| 2908745 | 12/1988 | Fed. Rep. of Germany . |
| 3727661 | 3/1989 | Fed. Rep. of Germany . |

*Primary Examiner*—Stephen M. Hepperle
*Attorney, Agent, or Firm*—Larson and Taylor

[57] ABSTRACT

The vaccum-operated draining system comprises a vacuum source (12), a manifold (14,16) connected thereto and a plurality of connecting conduits (22) connected thereto which are respectively closeable by a suction valve (24). To stabilize the vacuum available on the connecting conduits, thereby safe-guarding the operation of suction valves controlled in response to pressure, provision has been made that the manifold (14,16) between the connecting conduits (22) and the vacuum source (12) is continuously inclined and is dimensioned such that the inner cross-section thereof also at peak loads, in part, is clear.

10 Claims, 2 Drawing Sheets

VACUUM-OPERATED DRAINING SYSTEMS

Figure 1:
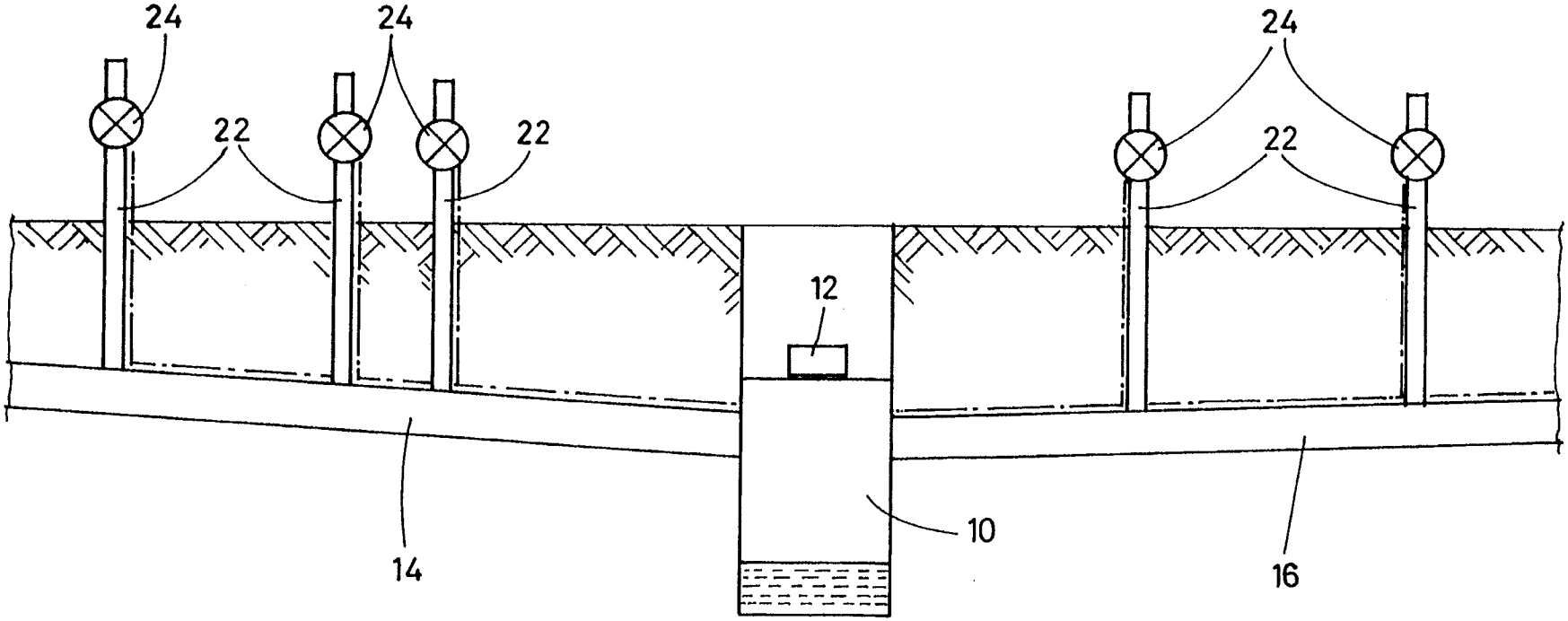

The present invention is concerned with a vacuum-operated draining system comprising a vacuum source, at least one manifold connected thereto and laid in or above ground and a plurality of connecting conduits connected thereto in spaced relationship and being closeable by suction valves actuatable independently of one another.

While in draining systems comprising sloping conduits the waste water is transported by gravity the transport in vacuum draining systems is based on the principle of plug conveyance wherein—as in pneumatic tube conveyors—a liquid plug seals the tube cross-section and is driven forwardly in the vacuum tube by a pressure difference between the front and rear sides. If the plugs during conveyance are overtaken by the air forcing them in that the same penetrates through the water flowing more slowly, depressions or pockets must be provided in a long manifold, for example every 20 meters, in which depressions or pockets the water left in the neighboring conduit sections is collected to form again plugs which are sealing the conduit cross-section and are transported at least to the next depression or pocket if by opening a valve again a pressure difference is generated between the side of a plug facing the outer end of the manifold and the side of the plug facing the vacuum pressure source.

Vacuum draining systems, in part, can also contain gravity conduits in which the vacuum of the system prevails (see DE 29 08 745 C2 and DE 26 37 962 B2). However, pockets or depressions are always provided between the vacuum pressure source, i.e. the vacuum pump and the house connections or other connections to be sucked in which pockets the water fills the cross-section of the conduit.

The afore-described functional principle of vacuum draining systems requires for a smooth operation that during each opening of a suction valve only a relatively small amount of water of a few liters is taken in together with a multiple air volume. Although the amount of air which is large compared to the amount of the water conveyed makes the operation of a vacuum draining system appear uneconomical, it is imperative and unavoidable in local draining systems of the plug conveying type that the suction valves on the individual house connections are operated separately from one another, depending on the waste water yield. In this respect, even a simultaneity factor is considered, characterizing the statistical probability that several house conduits leading to a manifold open simultaneously or at short intervals so that all of a sudden a particularly large amount of air is admitted which generates a large pressure difference towards the vacuum source thus being able to sufficiently accelerate also large water plugs or comparatively extended water columns formed on the pockets and depressions of the vacuum conduit so that they are transported at least to the next pocket or depression towards the vacuum source before the air penetrates like pearls therethrough. During less busy times, for example at night, where no simultaneity factor occurs, it may be necessary to open ventilation valves optionally provided in addition to the suction valves on the house connection conduits to prevent the draining system from being plugged by excessively long, inert water columns.

The conventional vacuum draining systems for the local drainage also operate at relatively high pressure fluctuations in the network in response to the load or filling thereof. On the one hand, this is due to the fact that the suction valve of a house connection will open automatically only if a predetermined minimum vacuum prevails in the manifold at the point of connection and, on the other hand, it is due to the fact that sufficiently large tanks are provided on the individual house connections accommodating and storing for an extended period of time a multiple of the water volume to be sucked during a process of exhaustion. If, hence, temporarily only a weak vacuum prevails in an individual line or in the whole line system the house connections affected thereby, temporarily, do not open until the situation has renormalized, optionally, by activating the afore-mentioned ventilation valves.

The suction valve on the house connections of the prior known vacuum draining systems are controlled such that at a predetermined filling level of the tank on the house connection and in the presence of an adequate vacuum in the vacuum line, they automatically open and after a predetermined period of time or after evacuation of the tank and, in addition, after a predetermined opening duration for the ingress of air, close again. It is irrelevant for the reliable operation of the system whether or not a tank is, in fact, completely evacuated during a process of exhaustion, for, if not completely evacuated, with an adequate vacuum available, a short time thereafter a new exhaust process is initiated.

However, situations may arise where, on the one hand, a drainage through off-flow by gravity is barred and where, on the other hand, even a vacuum draining system operating on the plug conveying principle is not always reliable in operation. Such situation for which, hitherto, a solution has not yet been developed is found, for example, where large-sized tanks have to be completely evacuated in a single exhaust operation through the connecting conduits or where, when opening a suction valve, a strong vacuum must be present with certainty such as in cases where the connecting conduits form or contain high rising sections and where the amount of liquid to be exhausted during a process of opening a suction valve has to overcome the riser height and must not fall back into the riser.

The afore-mentioned field of application in which relatively large tanks are to be exhausted is found, for example, in service railway stations where the waste water tanks of the wagons of a railway train are emptied. A valve control for the exhaust valves of such a draining system is described in EP 0 341 595 B1. The way of operation thereof is such that after initiating of an exhaust process the complete waste water tank connected is evacuated and the suction valve automatically closes if, after evacuation of the waste water tank, air is taken in, thereby causing the absolute pressure on the suction valve to rise. Although precautionary measures could also be taken, such as the provision of alarm systems or optical warning devices insuring that all waste water tanks of a train are completely evacuated before it starts on a new journey, this would, however, involve substantial additional efforts. Conversely, hitherto the risk has to be taken into account that closure of a suction valve before the complete evacuation of a tank escapes the attention of the service staff.

Early closure of a suction valve of the type as described in EP 0 341 595 B1and of other valves controlled in response to pressure can be released by pressure fluctuations which for the afore-described reasons hitherto have been unavoidable with vacuum draining systems. It is, therefore, the object of the invention to provide a vacuum-operated draining system of the afore-described type in which the vacuum available on the connecting conduits is stabilized by simple means so that the operation of suction valves controlled in response to pressure and, optionally, the exhaustion of waste water under difficult conditions, such as via high risers, is also insured.

The afore-described problem according to the invention is solved in that the manifold between the connecting conduits and the vacuum pressure source is continuously laid at a slope and is so dimensioned that the inner cross-section thereof also in peak loads, in part, is left clear.

The new draining system with the special subdivision of the manifold according to this proposal constitutes a combination of elements of a conventional gravity-type draining system and a vacuum-operated draining system. As set forth in the aforegoing also in vacuum draining systems for the local drainage the manifolds are laid with sloping sections in which the waste water flows by gravity towards the vacuum source. However, according to the invention it is not important by what force the water in the manifold is conveyed. What is important is that a continuously open connection not interrupted by water plugs in pockets or water columns of different lengths be established between the vacuum source and the individual suction valves so that vacuum from the vacuum source is applied also to the suction valves provided near the outer end of the manifold immediately through an empty space with no interruption through inert water plugs and water columns.

As opposed to conventional vacuum draining systems, in a system according to the invention the operation of the suction valves more distant from the vacuum source is left unaffected even if the relatively large volume of e.g. between five hundred to one thousand liters of waste water is evacuated within about two to three minutes from a railway wagon through a connecting line closer to the vacuum source. In the relatively narrow manifold of a vacuum draining system for the local drainage of a municipality such a large waste water volume admitted at one go to the manifold would form therein a long, inert water column behind which the vacuum created by the intake of air can break down to zero, thereby affecting the operation of all connections provided behind the long water column. As opposed thereto, according to the suggestion of the invention, the manifold is loaded only in part, preferably to half the height of its internal cross-section. Thanks to the continuous slope also the plug formation is avoided in the course of the manifold so that substantially the same vacuum prevails throughout the length thereof irrespective of the instantaneous load.

That it is not the type of discharge of the waste water but rather the supply of stabilized vacuum to the suction valves that is important to the invention is also revealed by the fact that in cases of application in which only a reliable operation of the pneumatic control means of the suction valves is to be insured, it can be provided, by way of alternative, that the control means of the suction valves are connected to the vacuum source through a control conduit separate from the manifold. A comparison with the former solution conveys that the free cavity above the water level in the manifold performs the function of the control conduit of the alternative solution. In the latter solution it is irrelevant whether the manifold functions as a gravity-type conduit or as a vacuum draining conduit operating on the plug conveyance principle.

While in a conventional vacuum conduit the pressure loss increases with the length of the conduit because pockets or depressions are available for the plug formation and because an excessively dimensioned conduit cross-section has a disadvantageous effect on the conveyance in the form of plugs the opposite is true in respect of the draining system according to the invention having a manifold the upper cross-sectional area of which is continually clear from waste water. The larger the free space in the manifold the larger the vacuum reservoir along with the cavity of the vacuum source available at any time. A large-volume vacuum reservoir involves the advantage that only relatively low pressure fluctuations are caused during opening of a suction valve by the in-flowing water and the air taken in. Preferably, the manifold has a length of several hundred meters and an inner diameter of at least approximately 125 mm.

Figure 2:
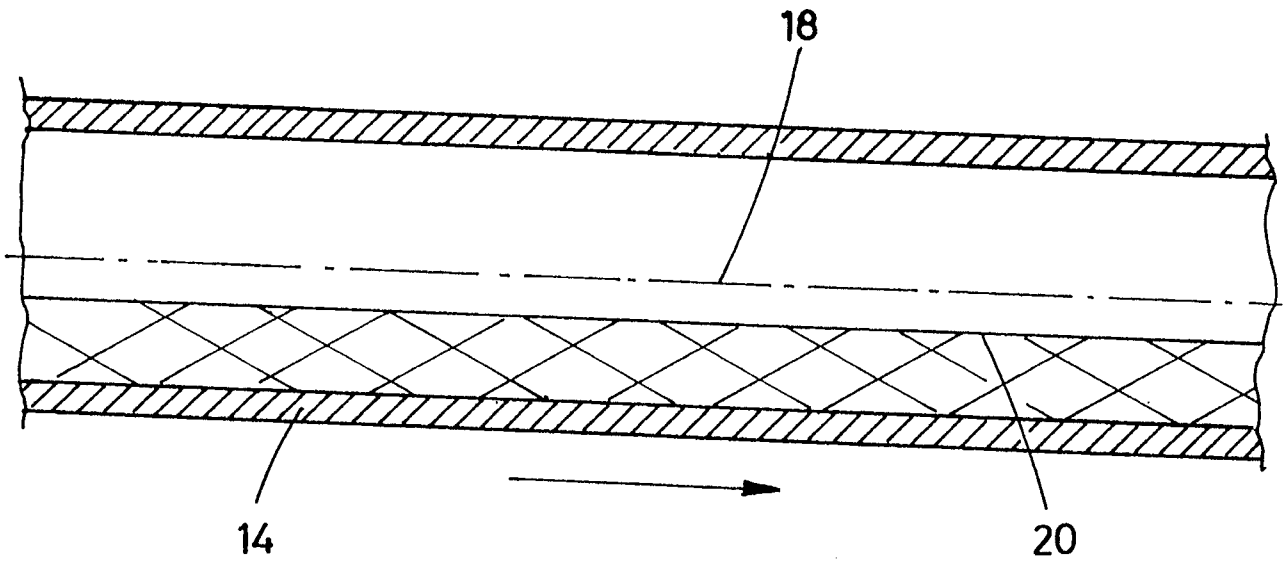

One form of embodiment of the invention will now be described in greater detail with reference to the drawing, wherein FIG. 1 is a schematical view of a vacuum draining system of a service railway station for the disposal of the waste water tanks of railway wagons;

FIG. 2 is a partial longitudinal section through a manifold of the draining system according to FIG. 1.

The vacuum draining system as shown comprises a central collecting space 10 permanently held by means of a vacuum pump 12 at a vacuum of a water column of about 5 to 7 m and serving as a vacuum source. Connected to the collecting space 10, above the water level, are two manifolds 14 and 16 laid in ground at a slope of at least 4 to 6 per mille towards the collecting space 10 and extending to opposite sides along the platform of a service railway station. The manifolds 14 and 16 comprise plastic tubes connected in pressure-tight manner and having internal diameters of e.g. about 150 mm. However, such an inner diameter, depending on the type of application, at the outer end of a manifold can also be slightly smaller, e.g. about 125 mm or, optionally, only 90 mm, while reaching, towards the collecting space 10, larger diameter values of, for example, 250 mm and more, with the layout in each length of a manifold section in the example being so selected that in a peak load the filling level numerically calculated from the rate of delivery per unit of time and the conduit cross-section extends only mid-way of the tube, as shown in FIG. 2 where the central longitudinal axis of the manifold 14 is designated by numeral 18 and the water level is designated by numeral 20.

A plurality of connecting conduits 22 terminate in the upper free area of the manifold 14,16 in a manner distributed throughout the length thereof, with the connecting lines 22 being of a substantially smaller cross-section than the manifolds so that even a large water volume exhausted in one go through a connecting line 22 despite the slower rate of flow within the manifold 14 or 16, respectively, does not fill the cross-section thereof. The connecting lines 22 respectively contain a suction valve 24 of the type as described in detail along with the control means in EP 0 341 595 B1. The suction valve 24 is opened after coupling of the connecting conduit of the waste water tank of a railway wagon and is automatically reclosed by the afore-mentioned pneumatic control means after the waste water tank of the railway wagon having been evacuated and only air is taken in. As all connecting conduits 22, through the upper hollow cavity of the manifolds 14 and 16 are directly connected to the vacuum source 10, 12, it is safeguarded that for the complete duration of a process of exhaustion through a desired connecting conduit 22, the vacuum of the system at the point of connection thereof does not break down, thereby avoiding an early closure of the suction valve 24.

Alternatively, in lieu of the connection of the pneumatic control means of the suction valves 24 through the upper free cavity of the manifold 14 to the vacuum source 10, 12, a control conduit 26 may be provided which is laid in side-by-side relationship therewith as shown in FIG. 1 in broken lines and which is also connected, at the top, to the collecting space 10. The control conduit 26 extends with branches along the individual connecting lines 22 towards the suction valves 24. When employing a control conduit 26 of this type the manifold 14 can also be of a smaller cross-section and can be laid with depressions and pockets for the formation of plugs that fill the complete cross-section of the line and are fed to the collecting space 10 through pressure fluctuations in the line.

I claim:

1. A vacuum-operated draining system comprising: a vacuum source for creating a vaccum, at least one manifold connected to the vacuum source, a plurality of connecting conduits connected to the manifold at intervals, and a suction valve for each connecting conduit, the suction valves being independently actuatable for closing an associated connecting conduit, characterized in that the manifold is continuously and without interruption inclined downwardly between the connecting conduits and the vacuum source and is so dimensioned that a part of the inner cross-section thereof at peak loads remains clear to conduct the vacuum through the manifold directly to the connecting conduits without interruption.

2. A draining system according to claim 1, characterized in that the length of the manifold is at least about 100 m.

3. A draining system according to claim 2, characterized in that the length of the manifold is more than 400 m.

4. A draining system according to claim 1, characterized in that the manifold also between second and third ones of the plurality of connecting conduits, counted from the outer end of the manifold, has an inner diameter of at least about 125 mm.

5. A draining system according to claim 1, characterized in that the manifold is laid with a slope of at least 4 per mille.

6. A draining system according to claim 1, characterized in that the inner cross-section of the manifold is so dimensioned that at peak loads it is filled, at the most, by about 75.

7. A draining system according to claim 1, characterized in that a closure movement of the suction valves is controlled in response to the pressure prevailing within the connecting conduit.

8. A draining system according to claim 1, characterized in that at least one connecting conduit comprises a riser of a height of more than 10 m.

9. A method of draining using a vacuum-operated draining system, which draining system includes a vacuum source which creates a vacuum, at least one manifold connected to the vacuum source, a plurality of connecting conduits connected to the manifold at intervals, and a suction valve for each connecting conduit with associated connecting conduit, said method comprising the steps of:

inclining the manifold continuously downwardly between the connecting conduits and the vacuum source, choosing the dimensions of the manifold so that a part of the inner cross-section thereof at peak loads remains clear, connecting a tank with fluid to be drained to the suction valve, opening of the suction valve, draining of the tank using the vacuum provided by the vacuum source, which vacuum is conducted through the part of the inner cross-section of the manifold such that the fluid is drawn into the manifold by the vacuum, and conducting the fluid drawn from the tank into the manifold by the inclination of the manifold toward the vacuum source.

10. A method for draining as claimed in claim 9 and further including the step of controlling the closing of the suction valves in response to a pressure prevailing within the associated connecting conduit.

* * * * *